United States Patent [19]

Takeshima et al.

[11] Patent Number: 5,015,863

[45] Date of Patent: May 14, 1991

[54] RADIATION SHIELD AND SHIELDING MATERIAL WITH EXCELLENT HEAT-TRANSFERRING PROPERTY

[75] Inventors: Eiki Takeshima, Chiba; Kiyoshi Takatsu, Matsudo; Norio Asano, Tokyo; Masahiro Hozumi, Matsudo, all of Japan

[73] Assignees: Sumitomo Heavy Industries, Ltd.; Nisshin Steel Co., Ltd., both of Tokyo, Japan

[21] Appl. No.: 469,857

[22] Filed: Jan. 23, 1990

[30] Foreign Application Priority Data

May 31, 1989 [JP] Japan ..... 1-136226

[51] Int. Cl.[5] ..... G21F 1/12; G21F 3/00

[52] U.S. Cl. ..... 250/515.1; 250/506.1; 250/518.1; 252/478

[58] Field of Search ..... 250/515.1, 506.1, 518.1; 252/478

[56] References Cited

U.S. PATENT DOCUMENTS

H558 12/1988 Coomes et al. ..... 252/478

4,868,400 9/1964 Barnhart et al. ..... 250/506.1

FOREIGN PATENT DOCUMENTS 3006507 8/1981 Fed. Rep. of Germany ... 250/506.1

62-25295 2/1987 Japan ..... 250/506.1

62-250172 10/1987 Japan .

63-18096 1/1988 Japan .

63-286534 11/1988 Japan .

1-149902 6/1989 Japan .

*Primary Examiner*—Jack I. Berman

*Attorney, Agent, or Firm*—Armstrong, Nikaido, Marmelstein, Kubovcik & Murray

[57] ABSTRACT

This invention relates to a shielding material used as a radiation shield of a container containing radioactive wastes. A radiation shield with an excellent heat-transferring property is fabricated from composite particles (A) obtained by coating core particles (a) of radiation-shielding property with a metal (b) of high thermal conductivity. Composite particles are formed into a certain shape of radiation shield by hot-press forming or other forming or packed into the internal space of radioactive waste container or the shield container cavity to compose a radiation shield.

6 Claims, 1 Drawing Sheet

RADIATION SHIELD AND SHIELDING MATERIAL WITH EXCELLENT HEAT-TRANSFERRING PROPERTY

FIELD OF THE INVENTION

This invention relates to a radiation shield with an excellent heat-transferring property that covers a container containing radioactive wastes.

Conventional shielding materials for neutrons and γ-rays, such as polyethylene and lead, generally have low thermal conductivity. When a container containing exothermic radioactive wastes is covered with these shielding materials, therefore, the heat in the container does not radiate outside and the temperature in the container rises, possibly damaging the soundness of the wastes. This has so far imposed various restrictions on the amount of wastes contained and the design of containers.

Explanation is given here of examples of three kinds of known shields applied to casks for the transportation and storage of spent nuclear fuels.

(1) A cylindrical container proper that contains a spent nuclear fuel assembly is externally covered with a neutron or γ-ray shield and the external surface of the shield, in turn, is covered with a shield cover. A large number of radiating fins whose ends are in contact with the external surface of the container body extend through the shield and shield cover up to the outside of the shield cover.

(2) A cylindrical container body that contains a spent nuclear fuel assembly is externally covered with a neutron or γ-ray shield and the external surface of the shield, in turn, is covered with a shield cover. A large number of radiating fins whose ends are in contact with the external surface of the container body extend through the shield nad shield cover up to the positionof the shield covr.

(3) A cylindrical container body that contains a spent nuclear fuel assembly consists of an internal cylinder and an external cylinder, and the space between the internal and external cylinders is filled with a neutron- or γ-ray-shielding material.

For the radiation-shielding materials used in these examples, a powder of metal with high thermal conductivity (e.g. copperA) is often contained in the shielding materials to improve their thermal conductivyt, and/or the radiating fins are installed inor through the shield to enhance their heat-transferring property, as mentioned above. These techniques, however, have some problems; for exaple, it is difficult to uniformly distribute the metal powder in the shield; it takes much time and labor to work the radiating fins and to install them in the container body; and neutrons stream through the radiating fins. Furthermore, it is pointed out that the decontamination property (ease of removing radiation contamination) is bad in the case of radiating fins described in paragraph 1).

SUMMARY OF THE INVENTION

Thus, the principal object of this invention is to provide a high-performance shielding material that combines the radiation-shielding function and an excellent heat-transferring property for the purpose of safely transporting and storing the exothermic radioactive wastes.

This object is accomplished by providing composite particles obtained by coating minute particles having radiation-shielding property with a metal of high thermal conductivity and fabricating a radiation shield in a various shape from these composite particles. Included among methods of fabricating a radiation shield of excellent heat-transferring property from composite particles are, for example, a method involving forming composite particles into a wall-like body as a shield by hot-press forming (or cold-press forming), and a method involving closely packing the space between walls composing the shield body with composite particles.

The core of a composite particle is made of a material selected from the group comprising polyethylene, polystyrene, polypropylene, bakelite, graphite, beryllium, oxides of beryllium, boron, compounds of boron, aluminum, oxides of aluminum, iron, ferroalloys, lead, lead alloys, gadolinium, oxides of gadolinium, cadmium, cadmium alloys, indium, indium alloys, hafnium, hafnium alloys, depleted uranium, and so on. The coating metal of high thermal conductivity is made of a material selected from the group comprising aluminum, aluminum alloys, beryllium, beryllium alloys, copper, copper alloys, iron, ferroalloys, silver, silver alloys, magnesium, magnesium alloys, molybdenum, molybdenum alloys, zinc, zinc alloys, tin, tin alloys, tungsten, tungsten alloys, iridium, iridium alloys, gold, and so on. The coating metal does not necessarily need to cover the whole surface of the core particle. It is desirable, however, to cover the whole surface in order to increase the thermal conductivity among composite particles by ensuring a large contact area of composite particles.

It is recommended that the packing density of particles be 1 to 3 g/cm$^3$, for example. According to the former method, i.e., the press forming method, composite particles are pressed to form a unit wall of appropriate size and this wall is attached to the container body. The deformation rate of composite particles, which depends on the materials used, is not very high because composite particles are minute.

In a shield obtained by the press forming of composite particles or a shield obtained by packing the space between walls with composite particles, core particles shield radiations, such as neutrons and γ-rays, emitted from exothermic radioactive wastes. On the other hand, the heat released from the radioactive waste in the container is transmitted through the container wall to the coating metal of composite particles which are in close contact with one another, and is released through this coating metal of high thermal conductivity to the external environment that surrounds the radioactive waste container. In other words, the radioactive shield on the basis of this invention is a high-performance shield that combines the radiation-shielding function and an excellent heat-transferring property.

These and other features of this invention will become apparent from the description of the following embodiments with reference to the accompanying drawings.

DESCRIPTION OF THE PREFERRED EMBODIMENT

Figure 1:
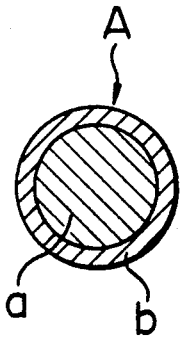
FIG. 1 is a sectional view of a composite particle A.

In this invention, composite particles A are used as the material for a shield that is required to provide the heat release function; they are obtained by coating minute core particles with an excellent radiation-shielding property of organic or inorganic materials, various kind of metals, and so on. It is about 20 to 100 μm, for example, in diameter and a thickness of the coating metal with high thermal conductivity is between 0.5 and 10 μm for example, as shown in FIG. 1.

Methods of applying the composite particles A to a radiation shield include (a) a method that involves filling a shield container of prescribed shape with composite particles A, (b) a method that involves fabricating a shield by closely packing the space in a container containing radioactive wastes, and (c) a method that involves forming composite particles A into a prescribed shape by hot-press forming (press forming at elevated temperature) or other forming processes.

Using these methods makes it possible to provide an excellent radiation shield with excellent heat transferring property for a container containing exothermic radioactive wastes. The two examples in which these methods are applied to a cask for transporting and storing spent nuclear fuels are described in the following with reference to FIGS. 2 and 3.

Figure 2:
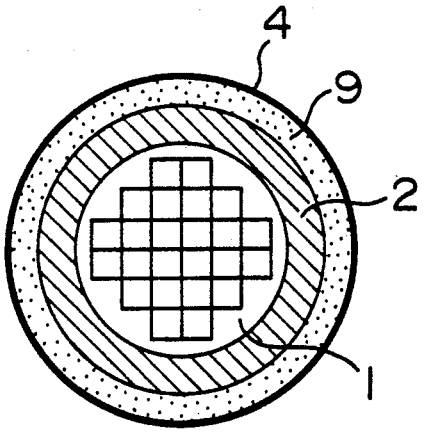
FIG. 2 and FIG. 3 are sectional views showing two examples in which the composite particle A is applied to a neutron and γ-ray shield of a cask for transporting and storing spent nuclear fuels.

FIG. 2 is a sectional view of the cask in which the cylindrical cask body 2 contains the spent nuclear fuel assemblies 1. The container body 2 is covered with a neutron shield 9 made of composite particles A according to this invention and this neutron shield is surrounded by neutron shield core 4.

Figure 3:
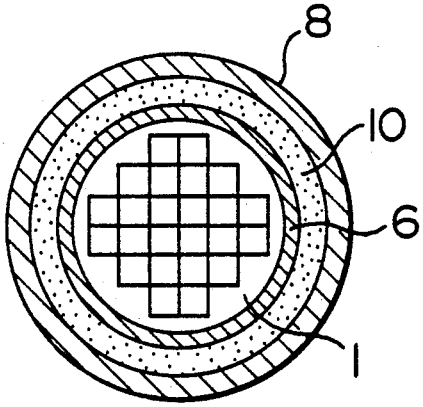

In the example shown in FIG. 3, a neutron and gamma (γ) ray shield 10 composed of composite particles A is formed on the basis of this invention between an internal cylinder 6 and an external cylinder 8 of the cask body.

In these shields, coated core particles a have the function of shielding radiations, such as neutron and gamma (γ) rays, and the coating metal b has the function of heat transfer and heat release; thus composite particles A serve as a shielding material with the function of heat transfer and heat release.

Concerning combinations of a core particle a and a coating metal b that compose a composite particle A, materials as shown below are selected depending on the service conditions. Materials for the core particle a include: polyethylene, polystyrene, polypropylene, bakelite, graphite, beryllium, oxides of beryllium, boron, compounds of boron, aluminum, oxides of aluminum, iron, ferroalloys, lead, lead alloys, gadolinium, oxides of gadolinium, cadmium, cadmium alloys, indium, indium alloys, hafnium, hanium alloys, depleted uranium, and so on. Materials for the coating metal b include: aluminum, aluminum alloys, beryllium, beryllium alloys, copper, copper alloys, iron, ferroalloys, silver, silver alloys, magnesium, magnesium alloys, molybdenum, molybdenum alloys, zinc, zinc alloys, tin, tin alloys, tungsten, tungsten alloys, iridium, irridium alloys, gold, and so on.

Examples of typical combination of these materials for composite particles A and particle sizes are shown in the following. Incidentally, particles are coated according to the electroplating process, spattering process, and so on (1) In the cafe of neutron shielding materials:

Polyethylene (including super-high-molecular polyethylene) or boron carbide ($B_4C$) is used for core particles a, and copper or aluminum is used for the coating metal b.

(2) In the case of gamma-ray-shielding materials:

Lead or depleted uranium is used for core particles a, and copper or depleted uranium is used for the coating metal b.

(3) In terms of the balance between the shielding performance and the heat release function, preferable diameters of core particle a are 20 to 100 μm and preferable thicknesses of coating metal b are about 0.5 to 10 μm.

The composite particles in accordance with this invention car also be applied to the neutron-shielding and blanket material of nuclear fusion reactors, neutron absorber for nuclear criticality safety control or neutron reflector of reactors in addition to the above application.

To sum up this invention, composite particles obtained by coating particles of a substance having an excellent radiation-shielding property with a metal of high thermal conductivity are used as a radiation-shielding material with an excellent heat-transferring property. As a result, it has become possible to obtain a high-performance shielding material that combines the radiation-shielding performance and an excellent heat-transferring property.

As will be apparent from the above, it has become possible to save the time and labor hitherto required for installing radiating fins in a shield and to obtain an excellent radioactive-substance-shielding material of good decontamination property without the problem of neutron streaming from the fins. In addition, it has become possible to eliminate the difficulty which has so far been encountered in uniformly mixing metal powder of high thermal conductivity into a shield and to achieve the high thermal conductivity which has not so far been obtained.

What is claimed is:

1. A radiation-shielding material comprising composite particles obtained by coating various kinds of minute particles of about 20μm to about 100 μm in diameter and having radiation-shielding property with the various kinds of metals of high thermal conductivity.

2. A shaped radiation-shielding material comprising a radiation-shielding material according to claim 1, which has been formed into composite particles by hot-press forming or other forming processes.

3. A shaped radiation-shielding material comprising a radiation-shielding material according to claim 1, wherein a radiation shield formed is comprised of not only the same kind of composite particles but also the different kinds of ones.

4. A shaped radiation-shielding material comprising a radiation-shielding material according to claim 1, wherein said composite particles are separately formed into various shapes of a radiation shield and appropriately combined in accordance with service conditions.

5. A radiation-shielding material according to claim 1, having a packing density of the composite particles in the range of from 1 to 3 g/cm$^3$.

6. A radiation-shielding material according to claim 1, wherein a core of said composite particles are made of at least one material selected from the group consisting of polyethylene, polystyrene, polypropylene, bakelite, graphite, beryllium, oxides of beryllium, boron, compounds of boron, aluminum, oxides of aluminum, iron, ferroalloys, lead, leaded alloys, gadolinium, oxides of gadolinium, cadmium, cadmium alloys, indium, indium alloys, hafnium, hafnium alloys, and delected uranium, and the coating of said composite particles is made of at least one material selected from the group consisting of aluminum, aluminum alloys, beryllium, beryllium alloys, copper, copper alloys, iron ferroalloys, silver, silver alloys, magnesium, magnesium alloys, molybdenum, molybdenum alloys, zinc, zinc alloys, tin, tin alloys, tungsten, tungsten alloys, iridium, iridium alloys, and gold.

* * * * *